United States Patent [19]

Cull et al.

[11] 3,957,502

[45] May 18, 1976

[54] ADDITION OF MAGNESIUM TO MOLTEN METAL

[75] Inventors: Geoffrey Maurice Cull, Salford; Phillip Andrew Fisher, Urmston, both of England

[73] Assignee: Magnesium Elektron Limited

[22] Filed: Sept. 9, 1974

[21] Appl. No.: 504,109

Related U.S. Application Data

[63] Continuation of Ser. No. 305,679, Nov. 13, 1972, abandoned.

[30] Foreign Application Priority Data

| | | |
|---|---|---|
| Nov. 17, 1971 | United Kingdom | 53409/71 |
| Nov. 17, 1971 | United Kingdom | 53410/71 |
| Oct. 13, 1972 | United Kingdom | 47350/72 |
| Oct. 13, 1972 | United Kingdom | 47352/72 |

[52] U.S. Cl. ..... 75/58; 75/65 R; 75/130 R

[51] Int. Cl.[2] ..... C22C 33/08; C21C 7/00

[58] Field of Search ..... 75/65, 130 R, 58, 130 A

[56] References Cited

UNITED STATES PATENTS

| | | | |
|---|---|---|---|
| 3,396,777 | 8/1968 | Reding | 75/130 R |
| 3,634,066 | 1/1972 | Matthews | 75/65 R |
| 3,637,373 | 1/1972 | Bylund | 75/58 |
| 3,656,989 | 4/1972 | Layland | 75/58 |
| 3,681,051 | 8/1972 | Takashima | 75/58 |
| 3,854,939 | 12/1974 | Mezoff | 75/130 R |

*Primary Examiner*—Peter D. Rosenberg
*Attorney, Agent, or Firm*—Karl W. Flocks

[57] ABSTRACT

A magnesium additive for ferrous melts comprises a structure of particulate magnesium and a material which forms a coherent, stable metal permeable matrix when subjected to the temperature of a ferrous melt. The additive may comprise magnesium granules enveloped with such a material, which may be carbon or calcium fluoride. The additive may also comprise a homogeneous mixture of magnesium with a refractory material, or may comprise magnesium surrounded by carbonaceous material capable of forming a skeletal carbon structure. The carbonaceous material may comprise an organic binder and may be mixed with other materials, such as carbon and calcium fluoride.

16 Claims, No Drawings

ADDITION OF MAGNESIUM TO MOLTEN METAL

This is a continuation of application Ser. No. 305,679, filed Nov. 13, 1972 and now abandoned.

BACKGROUND OF THE INVENTION

This invention relates to magnesium additives for iron and steel melts, and in this context magnesium is intended to include alloys consisting predominantly of magnesium.

In addition to its use as an alloy ingredient for metals, magnesium is also used in the treatment and refinement of metals and alloys. For example, it is known that the addition of magnesium to molten iron such as is delivered from a blast furnace results in a form of iron, frequently termed nodular or spheroidal graphite iron, which is more ductile than cast iron. Further examples include the addition of magnesium to certain iron melts to produce a malleable iron or at least an iron which can be converted to a malleable iron by an annealing process much less protracted than would normally be required and in the desulphurisation of certain steels. The removal of sulphur by magnesium proceeds more rapidly than removal by any other reagents, such as sodium carbonate and calcium carbide.

There are, however, problems in adding magnesium to molten iron and steel. Magnesium has a boiling point of about 1120°C whereas iron and steel have melting points of about 1400°C and 1500°C, respectively. Thus, not only does the magnesium when introduced into molten iron or steel tend to evaporate before it can be absorbed into the molten metal but it tends to evaporate so vigorously that molten metal is spattered about and in some instances an explosion may occur. Also, molten iron and steel have higher densities than magnesium and exhibit high surface tension effects so that it is difficult to make the magnesium that has not evaporated penetrate into the molten metal and become homogeneously distributed throughout the final cast product.

Various ways of overcoming these problems have been proposed and include placing the magnesium at the bottom of a receptacle and pouring the molten iron of steel on to it, or taking a quantity of molten iron or steel and introducing magnesium particulate form into the melt for example, by spreading the particles over the melt and stirring it vigorously, or by projecting the particles at the surface of the melt or by passing the particles through a tube of suitable material extending into the melt. Another way of introducing the magnesium into the melt that is finding increasing use is to introduce magnesium particles into the vortex created by pouring the melt through an annular orifice into a receptacle.

With all these ways the proportion of magnesium utilised in reaction with the iron or steel is only about 10 – 30%, the remainder being ejected from the melt as vapour with the result that there exists the dangers of spattering of molten metal and of explosion.

Attempts have been made to avoid these difficulties by impregnating a porous mass of carbon, such as coke, with magnesium and adding the mass to the ferrous melt. Such an impregnated mass has been made simply by immersing coke into molten magnesium. However, it is known that difficulties arise with this method of preparing such a material due to non uniformity of magnesium impregnation and contamination of the magnesium by, for instance, oxidation products during impregnation. Therefore the release of magnesium from such a material as vapour in a ferrous melt is still far from uniform and can give variable results.

SUMMARY OF THE INVENTION

According to one aspect of the invention, there is provided a magnesium based additive for a ferrous melt comprising a structure of particulate magnesium and a material which forms a coherent stable metal-permeable matrix when subjected to the temperature of a ferrous melt.

Said material may be carbonaceous and may comprise carbon itself or a compound which decomposes to give carbon at the temperature of a ferrous melt (generally in the range of 1400° to 1650°C).

According to one embodiment of the invention, the additive comprises magnesium particles which are enveloped in a material capable of providing an adherent coating thermally stable at a temperature in excess of about 900°C.

By "adherent coating" is meant a coating which will withstand normal handling and transporting, for example in bags or cans, without substantial reduction in thickness.

The materials which forms the coating of this embodiment may be carbon which adheres to the particles or an organic material decomposable to an adherent coating of carbonaceous material on heating to a temperature up to 900°C.

The magnesium particles used in this embodiment of the invention are preferably of a size ranging from 0.08 cm to about 0.65 cm and advantageously are equi-axial in form although they may tend towards flake form or spherical form. Turnings or raspings of magnesium are not found to be particularly useful.

The organic material may be a carbohydrate, but is preferably a polymeric material such as polysaccharides, methyl methacrylate, propylene glycol, polyethylene glycol, nylon, vinyl acetate. The organic coating material may include in its chemical structure an element or elements advantageous to the metal or alloy to be treated, for example silicon in the case of iron or steel. It is preferred, however, to avoid materials having in their chemical structure such elements as the volatile halides to avoid noxious fumes being given off when the material is carbonised or such elements that would have a deleterious effect on the metal or alloy being treated. The thickness of the organic material will vary according to the nature of the material selected but is preferably such that on carbonisation will leave an adherent coating of thickness ranging from 5 – 50% of the mean diameter of the magnesium particles. The organic material may be applied to the magnesium particles by any suitable technique, for example by forming a fluidised mass of the particles, spraying the mass with the organic material dispersed in a suitable liquid carrier and subsequently drying the material on the particles.

The magnesium particles may be coated with finely divided carbon or graphite by any suitable technique, for example that described for coating the granules with organic material with or without the use of a liquid carrier.

The adherent coating on the particles may also be a metal oxide, a mixture of metal oxide or a metal oxide complex, the particular oxide, oxide mixture or complex being selected so as to be inert with respect to molten magnesium and to have no deleterious effect on the molten metal or alloy being treated. Examples of metal oxides which may be used singly or in admixture include magnesium aluminium and titanium oxides. An oxide complex which may be used as a coating is a hydrated magnesium-aluminium-iron silicate known as vermiculite. The oxide, oxide mixture of oxide complex may be used in admixture with carbon as a coating material for the particles. These oxide-containing coating materials may be applied by any suitable technique, for example that described for the organic coating material although dispersion in a liquid carrier, in some instances, may not be required.

The adherent coating on the particles may advantageously comprise one or more metal fluorides having relatively low volatility at the temperature of the ferrous melt. These fluorides may be reducible to their respective metals by magnesium for the purpose of introducing such metals to the ferrous melt, for example, calcium which is a known powerful desulphuriser or rare earths metals such as cerium which are known to beneficially affect the sulphide distribution in the ferrous product finally obtained may be introduced into the melt in this way.

According to another embodiment of the invention, a granular additive for a ferrous melt comprises a homogeneous mixture of 30 – 90% by weight of magnesium and a refractory material.

Preferably the magnesium is present in the mixture in the range of 50 – 90% by weight.

Advantageously, the mixture is formed into granules ranging in size from about 1/32 inch to about ¼ inch and of substantially equiaxial form, preferably spherical but possibly of flake form.

The refractory material may be selected from the group of materials comprising carbon, a metal oxide, a mixture of metal oxides, a metal oxide complex or a metal carbide such as calcium carbide or may be a mixture of two or more materials of the group. The refractory material may comprise one or more fluorides such as $CaF_2$. When the refractory material comprises a metal compound, the compound is preferably selected such that it is either inert to the magnesium or is capable of reduction by the magnesium to its metal provided that the metal so produced is beneficial to the intended treatment of the ferrous melt. For example, if the treatment of iron or steel is being contemplated the oxides of magnesium, aluminium or titanium may be used since they satisfy the named conditions but the oxides of silicon or chromium are not preferred since they react with molten magnesium. An example of a metal oxide complex which may be used is a hydrated magnesium-aluminium-iron silicate known as vermiculite.

The granular material may be made by any suitable method, for example, by reducing the magnesium and the refractory material to a finely divided form, mixing the finely divided materials in the presence of a suitable binder using a fluidised bed technique, and drying the binder.

The granular material may be introduced into a molten mass of the metal or alloy to be treated, for example into molten iron or steel, in any of the known ways. It is believed that the dispersion of the magnesium by means of the refractory material reduces the normally vigorous reaction between the molten metal or alloy and magnesium at temperatures in excess of about 900°C to more manageable proportions. In the case of iron and steel, the reaction is reduced to an extent that the risk of spattering and explosion is also reduced while the proportion of added magnesium homogeneously incorporated in the resulting iron or steel is increased.

According to yet another embodiment of the invention, the additive comprises magnesium surrounded by carbonaceous material capable of forming a skeletal carbon structure upon subjection to the temperature of a ferrous melt. The magnesium is preferably in particulate form and may be mixed with particulate carbon and/or calcium fluoride, the mixture being bonded by means of a carbonaceous binder. Preferably the magnesium, the carbon and/or calcium fluoride and the binder are aggregated to constitute shaped bodies such as tablets or briquettes which desirably have a relatively high volume-to-surface ratio.

The magnesium particles of this embodiment preferably have an average size from 0.125 to 4 mm, advantageously 0.75 – 3 mm, and are preferably equiaxed, although particles of other shapes (e.g. elongated) may also be used. As in the case of the first described embodiment, coiled magnesium turnings may be used, but are not particularly advantageous.

The particulate carbon may be derived from materials such as coke, coal, graphite and lamp black.

The binder may comprise a wide range of organic compositions which give a skeletal carbon structure on heating. Compositions which may be used include phenolic resins, polysaccharides and epoxy resins. The amount of binder used is preferably not more than 4% by weight of the additive.

The additive of this embodiment preferably contains from 10 to 80% by weight of magnesium, the balance consisting essentially of the carbon and/or calcium fluoride and the binder. When the shaped bodies, e.g. tablets or briquettes are to be used for batch treatment of iron or steel (e.g., ladle treatment) a magnesium content of 25 – 50% by weight is preferred; when they are to be used for continuous treatment (e.g., in a running system) a magnesium content of 40 – 70% by weight is preferred.

The strength of the tablets or briquettes may be increased by adding a minor proportion of chromium sesquioxide to the binder, preferably in an amount not exceeding 5% by weight of the binder.

The shaped bodies such as tablets or briquettes can be manufactured simply by mixing the ingredients by a known method, followed by pressing portions of the mixture to the required size and shape in a press of conventional design.

On addition of the additive of this embodiment to molten ferrous metal, the binder material decomposes and a skeletal structure consisting essentially of carbon is formed. The skeletal structure so formed in conjunction with the carbon and/or calcium fluoride acts as a carrier medium of considerable strength. It is believed that, since this medium carries individual particles of magnesium as a substantially uniform dispersion, the magnesium diffuses progressively and uniformly in a controlled manner as vapour into the ferrous melt. This has the effect of increasing the proportion of the magnesium which diffuses into the molten metal rather than being lost by escape of the vapour at the surface of the melt.

It has been found, surprisingly, that the skeletal structure obtained from the tablets or briquettes is extremely resistant to chemical attack or to such factors as thermal shock and spalling sufficiently so to remain intact during treatment of the ferrous melt. The feature facilitates optimum utilisation of the magnesium.

This embodiment of the invention is particularly useful for the removal of sulphur from iron and steel, especially in the case of removing sulphur from blast furnace iron to low levels in short intervals of time. When using existing desulphurising agents such as soda ash or calcium carbide, the reaction time is longer and the removal of sulphur to low levels is impracticable.

For example, when an iron melt from a blast furnace containing 0.047% by weight of sulphur is treated with 0.09% of magnesium in the form of a briquette containing 50% of magnesium, the sulphur content is reduced to 0.019% by weight in about 2 minutes.

In this embodiment of the invention where no calcium fluoride is present the skeleton remaining, consisting substantially of carbon, may be troublesome insofar that it can result in contamination of the melt, being difficult to remove completely from the melt surface, and also tends to adhere to the inside of the treatment plunger when the latter is used for adding the shaped bodies, e.g. tablets or briquettes to the melt, after reaction of the magnesium. Removing this deposited adherent material from the plunger is a troublesome operation requiring additional labour and the deposited material may also reduce the working life of the inner surface of the plunger.

When calcium fluoride is present in the tablets or briquettes, it is believed to have the effect of causing progressive fusion of the surface layers of the tablets or briquettes in contact with the ferrous melt at a rate consistent with release of the magnesium into the melt. This is achieved without incurring any reduction in the uniformity of magnesium release to the melt, and at the same time eliminates contamination of the melt or treatment plunger by the carbon skeleton.

The calcium fluoride is present in the form of particles and preferably forms at least 10% of the weight of the tablets or briquettes. The calcium fluoride may be partially replaced with other fluorides, such as magnesium fluoride, alkaline earth and rare earth fluorides and zirconium double fluorides, but the amount of calcium fluoride is still preferably at least 10% by weight of the total mixture.

Other carrier materials may also be present, such as calcium oxide and iron powder.

Calcium oxide has the advantage of being a known desulphuriser but has the disadvantage of hydrating; so that tablets or briquettes incorporating CaO must be limited in composition and protected from atmospheric moisture. Iron powder may be advantageously added to increase the density of the additive.

The calcium fluoride slag also removes reaction products such as sulphides and oxides which are solid at the temperature of the melt and which would otherwise contaminate the melt.

It has also been found that, when the tablets or briquettes containing $CaF_2$ are added to a ferrous melt, some calcium sulphide and magnesium fluoride are formed, these compounds being absorbed by the remaining calcium fluoride as slag. It is believed that part of the magnesium from the tablet or briquette reacts with the calcium fluoride to form magnesium fluoride and calcium metal. The latter is a known powerful desulphuriser of ferrous melts and therefore reacts to form calcium sulphide. Unlike magnesium, calcium has little tendency to leave the surface of the melt as vapour because its boiling point is of the order of 1500°C.

The removal of some of the sulphur as calcium sulphide instead of magnesium sulphide also has the desirable effect of reducing the amount of gaseous sulphur dioxide, an obnoxious pollutant, which is discharged to the atmosphere during the process. It is believed that this is because calcium sulphide is less easily oxidised by atmospheric oxygen than magnesium sulphide, which is oxidised at the surface of the melt to magnesium oxide and sulphur dioxide.

The term "magnesium", as used in this specification, includes commercially pure magnesium and also magnesium alloys containing minor amounts of other constituents. Magnesium containing one of the rare earth metals as an alloying ingredient may be used, for example magnesium containing up to 10% by weight of cerium, preferably 1 – 3% by weight of cerium.

DESCRIPTION OF PREFERRED EMBODIMENTS

The use of additive according to the invention for nodularising and desulphurising iron is illustrated by the following examples.

EXAMPLE 1

Magnesium granules coated with sugar were added to molten iron from a blast furnace containing 0.014% by weight of sulphur at 1500°C. The granules contained 80% by weight of magnesium, with the balance sugar, and the weight of magnesium added was 0.21% of the weight of the iron.

When the reaction had finished it was found that the iron was nodularised and had a sulphur content of 0.008% by weight. The amount of magnesium retained in the iron was 0.040% of the weight of the iron.

EXAMPLE 2

Magnesium granules coated with carbon, containing 90% by weight of magnesium, were added to molten iron at a temperature of 1500°C containing 0.13% by weight of sulphur in such an amount that the weight of magnesium added was 0.17% by weight of the iron.

When the reaction had finished it was shown by analysis that the iron contained 0.007% of its weight of sulphur and 0.037% of its weight of retained magnesium. The iron was nodularised.

EXAMPLE 3

A typical blast furnace iron containing 0.06% by weight of sulphur was treated with a briquette containing 25% by weight of magnesium, the balance being calcium fluoride and a phenolic resin binder at a temperature of 1400°C, the amount of magnesium added was 0.09% by weight of the blast furnace iron.

One minute after the addition of the briquette it was found that the sulphur content of the iron was 0.018% by weight and hardly any sulphur dioxide was released.

A slag was formed on the surface of the melt having the following composition:

| | |
|---|---|
| $CaF_2$ | 35% by weight |
| CaS | 40% by weight |
| $MgF_2$ | 10% by weight |
| MgO | 15% by weight |

The composition of the slag indicates that part of the magnesium reacts in the melt with the calcium fluoride to give magnesium fluoride and calcium, which then reacts with sulphur to give calcium sulphide.

The above composition of the slag was established by X-ray analysis.

EXAMPLE 4

A sample of the molten iron as used in Example 3 was treated in the same manner with a briquette containing 50% by weight of magnesium but no calcium fluoride, the balance consisting of carbon and the organic binder. The amount of magnesium added was 0.09% of the weight of the iron, which had an initial sulphur content of 0.050%. The reaction time was about 2 minutes and the final sulphur content obtained with 0.016%, but an X-ray analysis of the slag indicated that it consisted mainly of iron oxides with no magnesium sulphide.

We claim:

1. A magnesium based additive for a ferrous melt comprising a structure of magnesium particles together with means to diffuse the magnesium progressively and uniformly in a controlled manner as vapor into the ferrous melt, said means to diffuse comprising an adherent coating of particles of a refractory material inert to magnesium at the melting point of the latter, the particles of refractory material being bonded to and substantially enveloping the magnesium particles and forming a coherent metal-permeable matrix through which the magnesium must pass when said structure is subjected to the temperature of a ferrous melt, and which refractory coating remains stable at least during the period said magnesium adjacent thereto passes therethrough, wherein the surface of said structure is substantially free of said magnesium.

2. An additive according to claim 1, in which the thickness of the adherent coating is from 5 to 50% of the diameter of the magnesium particles.

3. An additive according to claim 1, in which the diameter of the magnesium particles is from about 0.8 mm to about 6.5 mm.

4. An additive according to claim 1, which contains from 30% to 90% by weight of magnesium.

5. An additive according to claim 1, in which said refractory material is selected from the group consisting of carbon, and metal oxides or complexes containing metal oxides.

6. An additive according to claim 5, in which the refractory material is selected from magnesium oxide, aluminium oxide, titanium oxide, and vermiculite.

7. An additive according to claim 1, in which said adherent coating further comprises an organic binder.

8. An additive according to claim 7, in which the quantity of binder present does not exceed 4% by weight of the additive.

9. An additive according to claim 7, in which the binder is selected from phenolic resins, polysaccharides and epoxy resins.

10. An additive according to claim 7, in which the binder contains up to 5% by weight of chromium sesquioxide.

11. An additive according to claim 1, which also contains calcium fluoride.

12. An additive as claimed in claim 1, in which the magnesium contains a minor proportion of a rare earth metal.

13. An additive as claimed in claim 1, in which the constituents are aggregated to form tablets or briquettes.

14. A magnesium based additive for a ferrous melt comprising granules having a maximum dimension of from about 1/32 to ¼ inch and formed of magnesium particles bonded to particles of a refractory material inert to magnesium at the melting point of said magnesium, the particles of refractory material forming a coherent stable metal-permeable matrix enveloping the magnesium particles and through which the magnesium must pass when said granules are subject to the temperature of a ferrous melt.

15. An additive in accordance with claim 14 wherein said granules are aggregated into a shaped body.

16. In a method of adding magnesium to a ferrous melt, which comprises introducing the magnesium in particulate form into the melt, the improvement wherein said magnesium in particulate form comprises discrete granules each having a maximum dimension of from about 1/32 to about ¼ inch and each formed of one or more magnesium particles bonded to particles of a refractory material inert to magnesium at the melting point of said magnesium, the particles of refractory material forming a coherent stable metal-permeable matrix enveloping the magnesium and through which the magnesium must pass when said granules are subjected to the temperature of the ferrous melt, the surface of said granules being substantially free of said magnesium;

whereby said magnesium diffuses progressively and uniformly through said coherent metal-permeable matrix into said ferrous melt.

* * * * *